US007726404B2

(12) United States Patent
Kubala et al.

(10) Patent No.: US 7,726,404 B2
(45) Date of Patent: Jun. 1, 2010

(54) USE OF CARBON-DIOXIDE-BASED FRACTURING FLUIDS

(75) Inventors: Gregory Kubala, Houston, TX (US); Bruce A. MacKay, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 52 days.

(21) Appl. No.: 12/104,187

(22) Filed: Apr. 16, 2008

(65) Prior Publication Data

US 2009/0260828 A1 Oct. 22, 2009

(51) Int. Cl.
*E21B 43/267* (2006.01)
*E21B 43/27* (2006.01)

(52) U.S. Cl. ..... 166/308.2; 166/279; 166/280.1; 166/300

(58) Field of Classification Search ..... 166/308.2, 166/279, 280.1, 300
See application file for complete search history.

(56) References Cited

U.S. PATENT DOCUMENTS

| | | | | |
|---|---|---|---|---|
| 3,338,416 | A | 8/1967 | Barry | |
| 4,043,395 | A | 8/1977 | Every | |
| 4,107,096 | A | 8/1978 | McEntire | |
| 4,330,481 | A | 5/1982 | Timberlake | |
| 4,463,807 | A | 8/1984 | Stoddard | |
| 5,229,017 | A | 7/1993 | Nimerick | |
| 5,602,082 | A | 2/1997 | Hale | |
| 5,686,396 | A | 11/1997 | Hale | |
| 6,412,559 | B1 | 7/2002 | Gunter | |
| 6,660,693 | B2 | 12/2003 | Miller | |
| 6,929,069 | B2 | 8/2005 | Hinkel | |
| 7,051,809 | B2 | 5/2006 | Wilson | |
| 7,066,254 | B2 | 6/2006 | Vinegar | |
| 2004/0040708 | A1 * | 3/2004 | Stephenson et al. ..... | 166/280.1 |
| 2007/0235189 | A1 * | 10/2007 | Milne et al. ..... | 166/280.1 |
| 2008/0006410 | A1 * | 1/2008 | Looney et al. ..... | 166/308.4 |

* cited by examiner

*Primary Examiner*—David J Bagnell
*Assistant Examiner*—Catherine Loikith
(74) *Attorney, Agent, or Firm*—Martin Rzaniak; Dave Cate; Robin Nava

(57) ABSTRACT

A method of treating a shale-containing subterranean formation penetrated by a wellbore is accomplished by forming a carbon dioxide treatment fluid having a viscosity of less than about 10 mPa-s at a shear rate of about 100 $s^{-1}$. The carbon dioxide treatment fluid is introduced into the formation through the wellbore at a pressure above the fracture pressure of the formation. In certain embodiments, the treatment fluid may be comprised of from about 90% to 100% by weight carbon dioxide and may contain a proppant. A method of treating hydrocarbon-bearing, shale-containing subterranean formation penetrated by a wellbore may also be carried out by forming a carbon dioxide treatment fluid and introducing the carbon dioxide treatment fluid into the formation through the wellbore at a pressure above the fracture pressure of the formation. The formation being treated may have a permeability of less than 1 mD.

16 Claims, No Drawings

USE OF CARBON-DIOXIDE-BASED FRACTURING FLUIDS

BACKGROUND

The statements in this section merely provide background information related to the present disclosure and may not constitute prior art.

In the production of hydrocarbons from wells in subterranean formations, the formations are often stimulated to facilitate increased production of hydrocarbons. One method of stimulation is to hydraulically fracture the formation by introducing a fluid, known as a fracturing fluid or "frac fluid," into the formation through a wellbore and against the surface of the formation at a pressure sufficient to create a fracture or further open existing fractures in the formation. Usually a "pad fluid" is first injected to create the fracture and then a fracturing fluid, often bearing granular propping agents, is injected at a pressure and rate sufficient to extend the fracture from the wellbore deeper into the formation. If a proppant is employed, the goal is generally to create a proppant filled zone (aka, the proppant pack) from the tip of the fracture back to the wellbore. In any event, the hydraulically induced fracture is more permeable than the formation and it acts as a pathway or conduit for the hydrocarbon fluids in the formation to flow to the wellbore and then to the surface where they are collected. These methods of fracturing are well known and they may be varied to meet the user's needs, but most follow this general procedure.

The fluids used as fracturing fluids in such formations are typically fluids that have been "viscosified" or thickened, which facilitates fracturing and proppant transport. Viscosification of the fluid may be achieved through the addition of natural or synthetic polymers (cross-linked or uncross-linked). The carrier fluid is usually water or a brine that is viscosified with the viscosifying polymer, such as a solvatable (or hydratable) polysaccharide. The fluids used for hydraulic fracturing may also be viscosified or thickened with viscoelastic surfactants. These are non-polymer fluids that are typically formed from surfactants that are either cationic, anionic, zwitterionic, amphoteric or nonionic or employ a combination of such surfactants. In either case, such fracturing fluids are relatively costly due to the expense of the various components and additives used.

Additionally, while the use of such hydraulic fracturing fluids typically improves the overall permeability of the formation by establishing a high-permeability path between the newly-exposed formation and the wellbore, amounts of the viscosified fluids can leak off into the formation and may reduce the relative permeability in the invaded region after the treatment. In some cases, particularly near the fracture, the permeability to gas in some portions of the formation may be close to zero. Such low-permeability formations are commonly referred to as "tight". Clean up of these fluids is therefore an important consideration, which may add to the cost of treatment. And even with effective clean up, there is always the potential that some damage will remain.

The recovery of methane gas from tight subterranean formations has been a particular problem, especially in shales, such as Texas' Barnett Shale. In such formations, fracturing with conventional viscosified fracturing fluids may not be practical due to the expense and risk of damage to the already low permeability of the formation. One method of stimulating shale formations is through water or "slick-water" fracturing. In such fracturing operations, water, which may be combined with a friction reducing agent in the case of slick water, is introduced into the formation at a high rate to facilitate fracturing the formation. These fracturing fluids may produce longer although more narrow fractures and also use lighter weight and significantly lower amounts of proppant than conventional viscosified fracturing fluids. These water fracturing fluids are particularly useful in low-permeable, gas-bearing formations, such as tight-gas shale formations, where fracture width is of less concern. The water or slick-water fracturing fluids may be brine or fresh water, depending upon the properties formation being treated. The water fracturing fluids also require less cleanup than conventional viscosified fracturing fluids.

Water is in some ways a non-ideal liquid for shales because of the intrinsic water sensitivity of some shales and the behavior of trapped and/or adsorbed gases within the shales after the water-based treatment. The use of water fracturing may also be impractical in areas where water is scarce or in limited supply. Additionally, although water fracturing requires less cleanup than conventional viscosified fracturing fluids, residual water may remain in the formation after the fracturing operation. In certain instances, greater than 30% of the water used may remain in shale formations after the fracturing job. Additionally, other than facilitating the formation of fractures and channels in the formation, the water fracturing does nothing to facilitate further evolvement of methane or natural gas from the formation.

Accordingly, new and improved methods for stimulating production in hydrocarbon-bearing shale formations, particularly, methane or natural gas bearing formations, are needed.

SUMMARY

A method of treating a shale-containing subterranean formation penetrated by a wellbore is carried out by forming a carbon dioxide treatment fluid having a viscosity of less than about 10 mPa-s at a shear rate of about 100 $s^{-1}$. The carbon dioxide treatment fluid is introduced into the formation through the wellbore at a pressure above the fracture pressure of the formation. In certain embodiments the treatment fluid is comprised of at least about 90% to about 100% by weight carbon dioxide and may further contain a surfactant, which may include fluoropolymer surfactants. The treatment fluid may also contain proppants.

In another aspect, a method of treating a low permeability subterranean formation penetrated by a wellbore includes forming a carbon dioxide based treatment fluid having a viscosity of less than about 10 mPa-s at a shear rate of about 100 $s^{-1}$, wherein the fluid comprises a surfactant and at least about 70% to about 100% by weight carbon dioxide based upon total fluid weight. The carbon dioxide based treatment fluid is introduced into the formation through the wellbore at a pressure above the fracture pressure of the formation.

Another embodiment of the invention is a method of fracturing a hydrocarbon-bearing, shale-containing subterranean formation penetrated by a wellbore, which includes forming a carbon dioxide based treatment fluid having a viscosity of less than about 10 mPa-s at a shear rate of about 100 $s^{-1}$, the carbon dioxide treatment fluid has from about 90% to about 100% by weight carbon dioxide, and the fluid is introduced into the formation through the wellbore at a pressure above the fracture pressure of the formation.

In yet another aspect, disclosed is a method of treating hydrocarbon-bearing, shale-containing subterranean formation penetrated by a wellbore, including forming a carbon dioxide based treatment fluid and introducing the carbon dioxide based treatment fluid into the formation through the wellbore at a pressure above the fracture pressure of the formation, and subsequently introducing an aqueous fluid into the formation through the wellbore along with the final amounts of carbon dioxide based treatment fluid being introduced and/or as a subsequent stage after introduction of the carbon dioxide based treatment fluid.

In some embodiments of the invention, the fluid is partially aqueous, substantially nonaqueous, or nonaqueous. Methods of the invention may be used for any suitable subterranean formation, including those which are hydrocarbon bearing, water bearing, or even useful for injection wells.

In some embodiments, an aqueous fluid is introduced into the formation through the wellbore along with the final amounts of carbon dioxide treatment fluid being introduced and/or as a subsequent stage after introduction of the carbon dioxide treatment fluid.

DETAILED DESCRIPTION

The description and examples are presented herein solely for the purpose of illustrating the various embodiments of the invention and should not be construed as a limitation to the scope and applicability of the invention. While the compositions of the present invention are described herein as comprising certain materials, it should be understood that the composition could optionally comprise two or more chemically different materials. In addition, the composition can also comprise some components other than the ones already cited. In the summary of the invention and this detailed description, each numerical value should be read once as modified by the term "about" (unless already expressly so modified), and then read again as not so modified unless otherwise indicated in context. Also, in the summary of the invention and this detailed description, it should be understood that a concentration or amount range listed or described as being useful, suitable, or the like, is intended that any and every concentration or amount within the range, including the end points, is to be considered as having been stated. For example, "a range of from 1 to 10" is to be read as indicating each and every possible number along the continuum between about 1 and about 10. Thus, even if specific data points within the range, or even no data points within the range, are explicitly identified or refer to only a few specific, it is to be understood that inventors appreciate and understand that any and all data points within the range are to be considered to have been specified, and that inventors possession of the entire range and all points within the range.

Coal beds and hydrocarbon-bearing, shale-containing formations typically contain methane ($CH_4$) and small amounts of other light hydrocarbon gases. Carbon dioxide ($CO_2$) is known to displace methane from lattice structures, such as methane gas hydrates, methane THF clathrates, etc., and adsorbed methane from the surfaces, pore spaces, interstices, seams, etc. of the formation. This is contrasted with other gases, such as nitrogen or air that do not show a preferential tendency to displace the absorbed or latticed methane. Coal beds and gas hydrates, in particular, show preferential adsorption of or replacement by $CO_2$ compared to methane.

By injecting a carbon-dioxide treatment fluid into such formations at a pressure above the fracture pressure of the formation, the formations can be effectively fractured to stimulate production of methane and other hydrocarbon gases. The fracturing relieves stresses in the formation, decaps trapped gases and creates pore spaces and channels for the flow of gas from the formation into the wellbore. Additionally, because of the preferential displacement of absorbed or latticed methane by $CO_2$, further methane is evolved from the treatment than would otherwise occur with other fracturing treatments or with the use of other gases. The use of $CO_2$ also provides longer term enhancement of the overall gas production due the carbon dioxide's ability to displace methane.

If enough methane is displaced in the localized area of the fracture face surrounding the wellbore, the pressure in the formation may also drop sufficiently low so that it falls below the critical desorption pressure of methane within the formation. This can result in the spontaneous desorption and significant production of methane.

The shale formations that may be treated with the carbon dioxide fracturing fluid are tight or low-permeable formations. Such formations may have permeabilities of less than about 1 mD, less than about 0.5 mD or lower.

The carbon-dioxide treatment fluid is a non-gelled fluid and may have a low viscosity of less than about 10 mPa-s at a shear rate of about 100 $s^{-1}$, and more preferably, less than about 5 mPa-s at a shear rate of about 100 $s^{-1}$. The treatment fluid may contain any suitable amount of carbon dioxide, preferably from about 75% to about 100%, more preferably from about 90% to about 100% carbon dioxide, by weight of the fluid. The viscosity of the carbon-dioxide based treating fluid may be higher than those used for conventional water or slick-water fracturing. The carbon dioxide may be in a gaseous or supercritical state.

The treatment fluid may further contain a surfactant. These may be aliphatic or oxygen-containing hydrocarbon polymers, hydrofluoropolymers, or perfluoropolymers, partially or fully fluorinated small molecules with molecular weights up to 400 grams per mole, perfluoroethers, neutral surfactants, charged surfactants, zwitterionic surfactants, fatty acid esters, and/or surfactants that give rise to viscoelastic behavior. Examples of hydrocarbon polymers include pure polymers and block copolymers of styrene, α-olefins, and terpenoids, especially those with (tert-butyl)aryl substituents or isopropyl substituents. Examples of suitable hydrocarbon polymer surfactants include poly(vinyl acetate) which are particularly desirable because of their tendency to have higher cloud points in supercritical $CO_2$ as temperature increases (ref. Shen et al., *Polymer*, Vol. 44. Iss. 5, pgs 1491-1498 (2003)). Examples of suitable fluoropolymer surfactants include poly(fluoroalkylacrylates) with repeat units of the formula $[CH(C{=}O)OC_2H_4C_mF_{2m+1})]$, where m is between 3 and 19 and copolymers containing this repeat unit.

The carbon dioxide treatment fluid may be used in fracturing operations without any proppant. In certain embodiments, however, proppant may be included in the carbon dioxide treatment fluid to aid in propping the propagated fractures. In such instances, the proppant may be used in relatively small amounts. Because produced gases can be produced from formations having very narrow fractures, fracture width is less important than increased surface area provided from the fracturing treatment. Accordingly, the proppant used may have a smaller particle size than those used from conventional fracturing treatments used in oil-bearing formations. Where it is used, the proppant may have a size, amount and density so that it is efficiently carried, dispersed and positioned within the formed fractures.

In certain applications, the carbon dioxide may be used in combination with low viscosity aqueous fluids (e.g. <10 mPa-s), such as those slick-water fracturing fluids commonly used in fracturing shales. Such slick-water fracturing fluids may have small amounts of polyacrylamide, used for friction reduction. The aqueous fluids may be gelled aqueous fluid or a slick water aqueous fluid. These aqueous fluids could be foamed or energized with carbon dioxide. The $CO_2$ may be used to reduce the amount of water used in such conventional aqueous fluids. In certain cases, the low viscosity aqueous fluid, with or without $CO_2$, is introduced at the end or with the final amounts of the carbon-dioxide treatment fluid. This may be during the introduction of the final ⅓ or less of the carbon-dioxide treatment fluid. In such cases the aqueous fluid is combined with the carbon-dioxide fluid as the carbon-dioxide fluid is pumped generally continuously into the wellbore. Alternatively, the aqueous fluid may be introduced as a separate stage after introduction of all the carbon dioxide. The aqueous fluid may be used to facilitate transport of proppant for propping formation fractures.

In another embodiment, the carbon-dioxide treatment fluid may be used subsequent to a water fracturing operation. The carbon-dioxide treatment fluid may be introduced into the formation at above or below the fracture pressure. Addition of the carbon dioxide may facilitate further evolvement of methane gas from the fractured formation. It may also facilitate displacement and dewatering of the formation resulting from the prior water fracturing operation. The carbon-dioxide treatment fluid may be introduced immediately after the water fracturing operation or in refracturing a formation that has been fractured through conventional water or viscosified hydraulic fracturing fluids. This may be useful particularly for non-coal, shale-containing formations, or any other low permeability formations.

The present invention provides certain advantages. As discussed previously, the carbon-dioxide treatment fluid is well suited in treating tight or low permeable formations where conventional viscosified fracturing fluids cannot be used without significant formation damage. The carbon-dioxide treatment fluid can be used for fracturing in areas where water is scarce or in limited supply. Additionally, the carbon-dioxide based fracturing fluids avoid the permeability damage that may result with even water and slick-water fracturing fluids, which can leave as much as 30% or more water in the formation. The carbon-dioxide treatment fluid can be provided with viscosities greater than those of water and slick-water fracturing fluids. This allows greater fracture length and penetration into the formation without the resulting damage of the water-based fluids. The carbon dioxide may also act as a dewatering agent, making it particularly useful subsequent to water fracturing or in refracturing operations.

In addition to the above advantages, the carbon dioxide provides further displacement of methane within the formation because of its preferential absorption to the surfaces of the formation compared to methane. The fracturing treatment and/or the preferential absorption of $CO_2$ can also lead to spontaneous desorption of methane if enough methane is produced such that the formation pressure drops below the critical methane desorption pressure.

While the invention has been shown in only some of its forms, it should be apparent to those skilled in the art that it is not so limited, but is susceptible to various changes and modifications without departing from the scope of the invention. Accordingly, it is appropriate that the appended claims be construed broadly and in a manner consistent with the scope of the invention.

What is claimed is:

1. A method of treating a low permeability subterranean formation penetrated by a wellbore, the method comprising:

forming a carbon dioxide based treatment fluid having a viscosity of less than about 10 mPa-s at a shear rate of about 100 $s^{-1}$, the fluid comprising a surfactant and at least about 70% by weight carbon dioxide based upon total fluid weight; and, introducing the carbon dioxide based treatment fluid into the formation through the wellbore to treat the formation.

2. The method of claim 1, wherein the treatment fluid is comprised of at least about 90% by weight carbon dioxide based upon total fluid weight.

3. The method of claim 1, wherein the treatment fluid is substantially nonaqueous.

4. The method of claim 1, wherein the surfactant is a hydrocarbon polymer or fluoropolymer surfactant.

5. The method of claim 1, wherein the treatment fluid consists essentially of carbon dioxide.

6. The method of claim 1, wherein the subterranean formation is a shale-containing formation having a permeability of less than about 1 mD.

7. The method of claim 1, wherein the treatment fluid further contains a proppant.

8. The method of claim 1, further comprising introducing an aqueous fluid into the formation through the wellbore along with the final amounts of carbon dioxide treatment fluid being introduced and/or as a subsequent stage after introduction of the carbon dioxide treatment fluid.

9. A method of fracturing a hydrocarbon-bearing, shale-containing subterranean formation penetrated by a wellbore, the method comprising:

forming a carbon dioxide based treatment fluid having a viscosity of less than about 10 mPa-s at a shear rate of about 100 $s^{-1}$, the carbon dioxide treatment fluid comprising a surfactant and at least about 90% by weight carbon dioxide; and introducing the carbon dioxide based treatment fluid into the formation through the wellbore at a pressure above the fracture pressure of the formation.

10. The method of claim 9, wherein the treatment fluid consists essentially of carbon dioxide.

11. The method of claim 9, wherein the subterranean formation is a shale-containing formation having a permeability of less than about 1 mD.

12. The method of claim 9, wherein the treatment fluid further comprises a proppant.

13. The method of claim 9, further comprising introducing an aqueous fluid into the formation through the wellbore along with the final amounts of carbon dioxide based treatment fluid being introduced and/or as a subsequent stage after introduction of the carbon dioxide based treatment fluid.

14. The method of claim 9, wherein the treatment fluid is substantially nonaqueous.

15. The method of claim 9, wherein the method is performed subsequent to a water fracturing operation.

16. The method of claim 9, provided the shale-containing subterranean formation is not a coal bed.

* * * * *